US008929763B2

(12) United States Patent
Mukai

(10) Patent No.: US 8,929,763 B2
(45) Date of Patent: Jan. 6, 2015

(54) FUSING DEVICE AND IMAGE FORMING APPARATUS

(75) Inventor: Takashi Mukai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 116 days.

(21) Appl. No.: 13/618,151

(22) Filed: Sep. 14, 2012

(65) Prior Publication Data

US 2013/0089350 A1 Apr. 11, 2013

(30) Foreign Application Priority Data

Oct. 6, 2011 (JP) ..... 2011-222296

(51) Int. Cl.
*G03G 15/20* (2006.01)

(52) U.S. Cl.
CPC ..... *G03G 15/2053* (2013.01); *G03G 15/2082* (2013.01); *G03G 2215/2032* (2013.01); *G03G 15/2078* (2013.01)
USPC ..... 399/69; 399/329

(58) Field of Classification Search
CPC ..... G03G 15/20
USPC ..... 399/69
See application file for complete search history.

(56) References Cited

U.S. PATENT DOCUMENTS

| | | | | |
|---|---|---|---|---|
| 5,832,353 | A * | 11/1998 | Sano | 399/329 |
| 6,173,152 | B1 * | 1/2001 | Schlueter et al. | 399/328 |
| 6,212,356 | B1 | 4/2001 | Ishikawa et al. | |
| 7,313,353 | B2 * | 12/2007 | Satoh et al. | 399/329 |
| 8,391,764 | B2 * | 3/2013 | Tanaka et al. | 399/329 |
| 2006/0171731 | A1 * | 8/2006 | Yoshikawa | 399/69 |
| 2009/0269108 | A1 * | 10/2009 | Condello et al. | 399/329 |
| 2011/0236089 | A1 * | 9/2011 | Tanaka et al. | 399/329 |

FOREIGN PATENT DOCUMENTS

| | | | |
|---|---|---|---|
| JP | 2-143274 | A | 6/1990 |
| JP | 2001-343850 | A | 12/2001 |
| JP | 2003-195669 | A | 7/2003 |
| JP | 2007-178828 | A | 7/2007 |
| JP | 2008-159515 | A | 7/2008 |
| JP | 2011-209409 | A | 10/2011 |
| WO | WO 99/00713 | A1 | 1/1999 |

* cited by examiner

*Primary Examiner* — Clayton E LaBalle
*Assistant Examiner* — Kevin Butler
(74) *Attorney, Agent, or Firm* — Birch, Stewart, Kolasch & Birch, LLP

(57) ABSTRACT

A fuser portion is configured to include a fuser roller, a tension roller, an endless fuser belt stretched over the fuser roller and the tension roller, a heater unit for heating the fuser belt, and a pressure roller pressed to the fuser roller through the fuser belt. The heater unit is so arranged as to be pressed to the fuser belt, while the tension roller has a thermal insulation layer arranged on its outer circumference touching the fuser belt.

16 Claims, 6 Drawing Sheets

FIG. 6

| | THERMAL INSULATION LAYER | OUTER DIAMETER (mm) | WARM UP TIME (sec) |
|---|---|---|---|
| EXAMPLE 1 | USE | 12.3 | 18.6 |
| EXAMPLE 2 | USE | 14 | 20.6 |
| COMPARATIVE EXAMPLE | NOT USE | 12 | 25.2 |

FUSING DEVICE AND IMAGE FORMING APPARATUS

CROSS-REFERENCE TO RELATED APPLICATIONS

This Nonprovisional application claims priority under 35 U.S.C. §119(a) on Patent Application No. 2011-222296 filed in Japan on Oct. 6, 2011, the entire contents of which are hereby incorporated by reference.

BACKGROUND

1. Technical Field

The present invention relates to a fusing device for fixing an image on a sheet, and to an image forming apparatus including the same.

2. Description of Related Art

In resent years, image forming apparatuses of an electrophotographic system (hereinafter simply referred to as "image forming apparatus") have been widely used mainly in offices and the like. The image forming apparatus includes a photoreceptor, a charging means, an exposing means, a developing means, a transfer means and a fixing means for performing charging, exposing, developing, transferring and fixing procedures to form an image on a sheet-like recording medium (hereinafter also simply referred to as "sheet").

As a fixing means, a fusing device of a heat roller fusing system is used for example. The fusing device includes a fuser roller and a pressure roller. The fuser roller and pressure roller form a pair of rollers that are pressed to be in contact with each other. A thermal source such as a halogen heater is arranged as a heating means inside at least one of the fuser roller and pressure roller.

In the fixing procedure, the thermal source heats the pair of rollers to a predetermined temperature required for fusing (hereinafter referred to as "fusing temperature"), and then a recording medium on which a to-be-fixed toner image is formed is fed to a fuser nip which is a portion where the fuser roller and pressure roller are pressed to be in contact with each other. The toner image passing through the fuser nip is fused by the heat transferred from at least one of the fuser roller and pressure roller and is fixed to a recording medium such as a sheet of paper by a pressure from the fuser roller and pressure roller. If the time required for the thermal source to raise the temperature of the fusing device to a fusing temperature (hereinafter referred to as "warm-up time") is long, it takes time to form an image on the recording medium. A shorter warm-up time would improve the user's convenience.

The fusing device attached to the image forming apparatus capable of full color printing uses a fuser roller having a surface provided with an elastic layer formed of, for example, silicone rubber. Such a fuser roller causes the elastic layer on the surface of the fuser roller to be elastically deformed to correspond with the irregularity of the to-be-fixed toner image, making the fuser roller in contact with and cover up the to-be-fixed toner image. This allows a multicolor to-be-fixed toner image having a larger amount of toner than that of a single color image to more firmly be fixed.

Moreover, the strain relief effect of the elastic layer can improve releasability of multicolor toner which tends to be easily offset compared to a single color image. More specifically, the elastic layer compressed and strained at the fuser nip is released from the strain at the exit of the fuser nip, causing misalignment between the elastic layer and toner image at the exit of the fuser nip. As a result, the adhering force on the elastic layer to the toner image is reduced, allowing the image to easily be released from the layer. Furthermore, as the nip shape of the fuser roller and pressure roller at the fuser nip comes to have a convex shape toward the fuser roller side (inverse nip shape), the recording medium can more easily be stripped off from the fuser roller. As a stripping means for separating the fuser roller from the recording medium, self stripping can be realized which allows the recording medium to be separated from the fuser roller without the use of, for example, a strip claw. Therefore, an image failure due to the stripping means can be resolved.

In order to accommodate a higher speed, it is necessary to increase the width of the fuser nip (hereinafter referred to as "fuser nip width"). For increasing the fuser nip width, two ways are listed as examples, including thickening the elastic layer of the fuser roller and increasing the diameter of the fuser roller. As the elastic layer of the fuser roller has a very low thermal conductivity, a thicker elastic layer would increase the warm-up time when a heating means is provided inside the fuser roller. If the processing speed is increased, the temperature of the fuser roller will not follow the fusing temperature. In addition, an increased diameter of the fuser roller would increase the thermal capacity, adversely increasing the power consumption by the heating means.

International Patent Publication WO99/00713 discloses a fusing device for accommodating the increased speed while reducing the warm-up time and power consumption. The fusing device disclosed in WO99/00713 includes a fuser roller, a pressure roller, a heating roller and an endless belt, which uses a belt fixing method in which the endless belt is stretched over the fuser roller and heating roller to make the fuser roller and pressure roller press each other through the endless belt. Since the fusing device does not need a heating means installed in the fuser roller, an elastic layer at the fuser roller may be made thicker and the diameter of the fuser roller is made larger in order to accommodate the increased speed. In addition, the heating roller containing a heater inside can heat the endless belt which has a small thermal capacity, eliminating the need for heating the elastic layer which has a large thermal capacity. This can shorten the warm-up time and avoid increase in power consumption.

Furthermore, Japanese Patent Application Laid-Open No. 02-143274 proposes a fusing device including a fuser head containing a planar heat generator as a heating means, which is arranged opposite from a pressure roller, the heat from the heating means being applied through the fuser belt to a recording medium which is to be heated, to fix a to-be-fixed toner image on the recording medium. The fusing device disclosed in Japanese Patent Application Laid-Open No. 02-143274 can reduce the thermal capacity of the planar heat generator compared to the thermal capacity in the case where a halogen heater is used as the heating means, reducing the power consumption and warm-up time.

SUMMARY OF THE INVENTION

The fuser device disclosed in International Patent Publication WO99/00713 includes a halogen lamp heater inside the heating roller, which requires the heating roller itself to be reduced in thickness to have a smaller thermal capacity in order to shorten the warm-up time by the halogen lamp heater. In addition, the diameter of the roller needs to be increased in order to attain a sufficient strength with having a reduced thickness heating roller, resulting in the problem of increase in size of the device.

Moreover, the configuration in which the fuser head is opposed to the pressure roller as disclosed in Japanese Patent Application Laid-Open No. 02-143274 needs to provide, in addition to the fuser head, several rollers for stretching the fuser belt, resulting in the problem of increase in size of the device.

The present invention has been contrived in view of the above circumstances. An object of the invention is to provide a fuser device and an image forming apparatus, each of which has a small size and which can reduce power consumption and warm-up time.

A fusing device according to the present invention for fixing an image to a sheet is characterized by including: a fuser roller; a tension roller arranged in parallel with the fuser roller; an endless fuser belt stretched with tension over the fuser roller and the tension roller; a heater for heating the fuser belt; and a pressure roller pressed to the fuser roller through the fuser belt for conveying a sheet carrying an image formed with a developer while sandwiching the sheet between the pressure roller and the fuser belt, and is characterized in that the heater is arranged to be pressed to the fuser belt, and the tension roller has a thermal insulation member arranged at an outer circumference touching the fuser belt.

According to the present invention, the endless belt is stretched with tension over the fuser roller and tension roller, the heater for heating the fuser belt is arranged to be in press-contact with the fuser belt, and the thermal insulation member is arranged at the outer circumference of the tension roller, which touches the fuser belt. This can prevent the heat from transferring to the tension roller and can shorten the warm-up time.

The fusing device according to the present invention is characterized in that the tension roller has a diameter smaller than a diameter of the fuser roller.

According to the present invention, the diameter of the tension roller is smaller than that of the fuser roller, allowing the device to have a reduced size.

The fusing device according to the present invention is characterized in that the heater is arranged inside an orbit around which the fuser belt revolves.

According to the present invention, the heater is arranged inside the orbit around which the fuser belt revolves, allowing the device to have a reduced size.

The fusing device according to the present invention is characterized in that the heater includes a heat generator and a heat transmission member having a surface touching the fuser belt forming an arc plane, for transmitting heat from the heat generator to the fuser belt.

According to the present invention, since the surface of the heat transmission member for transmitting heat to the fuser belt forms an arc plane and the surface is in contact with the fuser belt, the surface of the heat transmission member can be in close contact with the surface of the fuser belt, allowing the heat from the heat generator to be better transmitted.

The fusing device according to the present invention is characterized in that a fluorine contained resin layer is formed on the surface of the heat transmission member.

According to the present invention, the fluorine contained resin layer is formed on the surface of the heat transmission member, achieving favorable sliding between the surface and the fuser belt, allowing the fuser belt to be better slidable.

The fusing device according to the present invention is characterized in that the thermal insulation member arranged at the tension roller is formed with a porous material.

According to the present invention, since the thermal insulation member arranged at the tension roller is formed with a porous material, heat insulation by the heat insulation member can be enhanced while the warm-up time can be shortened.

The fusing device according to the present invention is characterized by further including: a detector for detecting a temperature of the fuser belt; and a control portion for controlling power supplied to the heater such that the fuser belt has a set temperature based on a detection result obtained by the detector.

According to the present invention, since the control portion performs control for the fuser belt to have the set temperature, the temperature of the fuser belt is controlled to be a temperature required for fusing and thus an image can be fixed to a sheet.

The fusing device according to the present invention is characterized by further including a heater for heating the pressure roller.

According to the present invention, the heater for heating the pressure roller is provided, so that the warm-up time can be shortened.

The fusing device according to the present invention is characterized by further including a heater for heating the fuser roller.

According to the present invention, the heater for heating the fuser roller is provided, so that the warm-up time can be shortened.

An image forming apparatus according to the present invention is characterized by including: a transfer portion for transferring an image formed with a developer to a sheet based on obtained image data; and the fusing device described above. An image is formed by fixing an image with the fusing device.

According to the present invention, by the transfer portion transferring an image formed with a developer to the sheet and the fusing device fusing to fix the image, image forming can be performed. According to the present invention, the endless fuser belt is stretched over the fuser roller and tension roller, and the heater for heating the fuser belt is arranged to be in press-contact with the fuser belt while a thermal insulation member is arranged at the periphery where the tension roller is in contact with the fuser belt. This can suppress the heat transfer to the tension roller and shorten the warm-up time.

The above and further objects and features of the invention will more fully be apparent from the following detailed description with accompanying drawings.

BRIEF DESCRIPTION OF THE SEVERAL VIEWS OF THE DRAWINGS

FIG. 6 is a chart showing warm-up time in each example.

DETAILED DESCRIPTION

An image forming apparatus according to an embodiment of the present invention will now be described below with reference to the drawings. Note that the description below should be interpreted as illustrative but not limitative in any way in the present invention.

Figure 1:
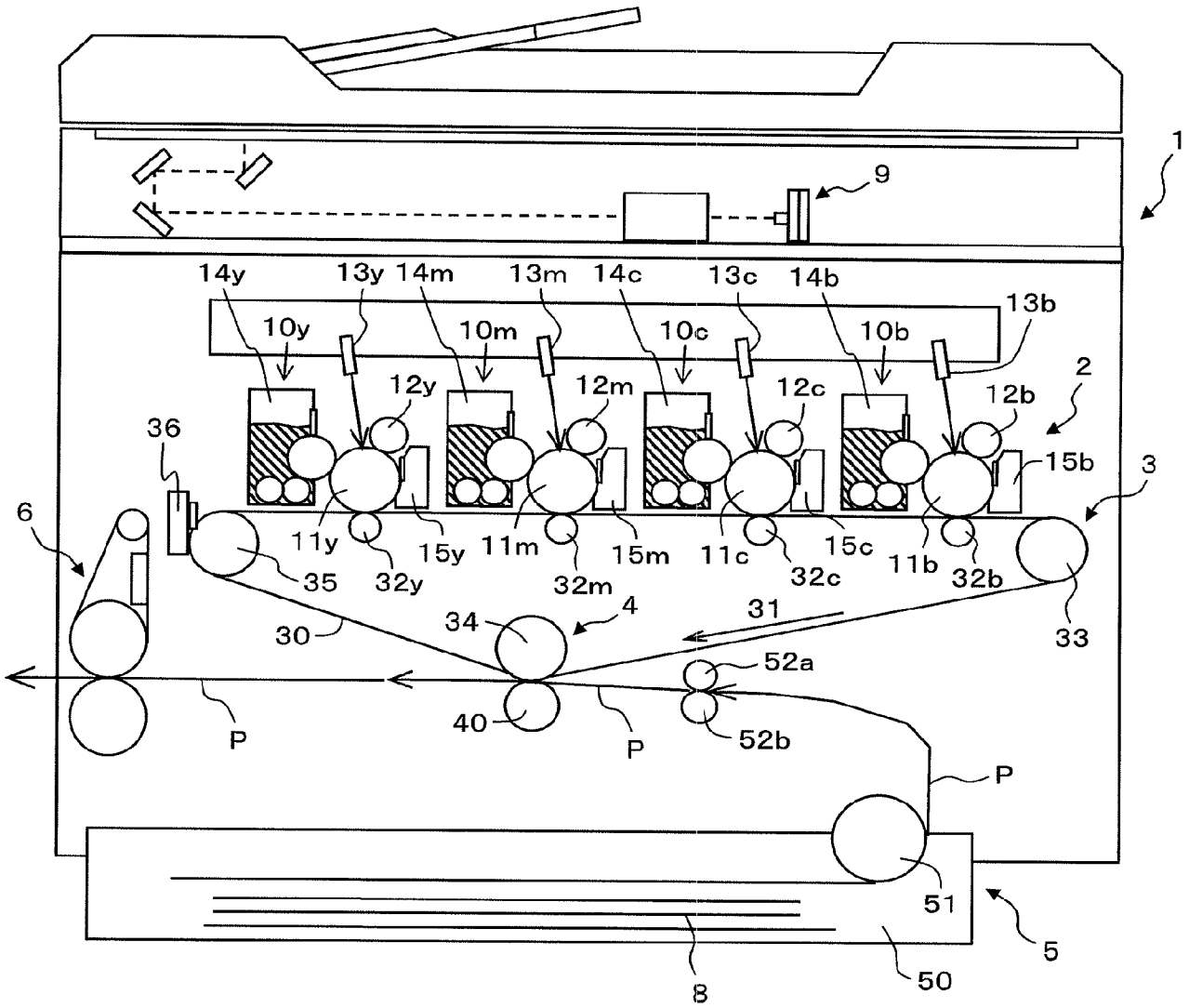
FIG. 1 is a schematic view illustrating an example of an image forming apparatus according to an embodiment of the present invention.

FIG. 1 is a schematic view illustrating an example of an image forming apparatus 1 according to an embodiment of the present invention. The image forming apparatus 1 includes an image forming portion 2, an intermediate transfer portion 3, a secondary transfer portion 4, a recording medium feeder 5, a fuser portion 6 which is the fusing device of the present invention, as well as an operation portion, a control portion and the like which are not shown in FIG. 1.

Configuration and Operation of Image Forming Portion 2

The image forming portion 2 includes image generating units 10*y*, 10*m*, 10*c* and 10*b*. Each of the image generating units 10*y*, 10*m*, 10*c* and 10*b* forms an electrostatic latent image corresponding to digital signals for each hue (hereinafter referred to as "image information"), develops the latent image and forms an image with a developer (toner image) for each color. Here, the image information is generated from a document image read out by an image reading portion 9. The image generating unit 10*y* forms a toner image corresponding to image information on the color of yellow, while the image generating unit 10*m* forms a toner image corresponding to image information on the color of magenta. The image generating unit 10*c* forms a toner image corresponding to image information on the color of cyan, while the image generating unit 10*b* forms a toner image corresponding to image information on the color of black.

The difference among the image generating units 10*y*, 10*m*, 10*c* and 10*b* is that a yellow developer, a magenta developer, a cyan developer and a black developer are respectively used, and that a pixel signal corresponding to a yellow color component image, a pixel signal corresponding to a magenta color component image, a pixel signal corresponding to a cyan color component image and a pixel signal corresponding to a black color component image, among the image information input to the image forming portion 2, are input to the respective image generating units. Since the constructions of the image generating units 10*y*, 10*m*, 10*c* and 10*b* are similar to each other, the image generating unit 10*y* corresponding to yellow will be described as an example, whereas the other image generating units will not be described in the following description.

Note that, when indicating each image generating unit 10 or the like corresponding to each color, each of the alphabet characters, i.e. y (yellow), m (magenta), c (cyan) and b (black), is added to a reference number. The image generating units 10*y*, 10*m*, 10*c* and 10*b* are arranged sequentially in this order in the moving direction of an intermediate transfer belt 30 (in the direction orthogonal to the scanning direction), which will be described later, i.e. from the upstream side to the downstream side in the direction indicated by an arrow 31.

Figure 2:
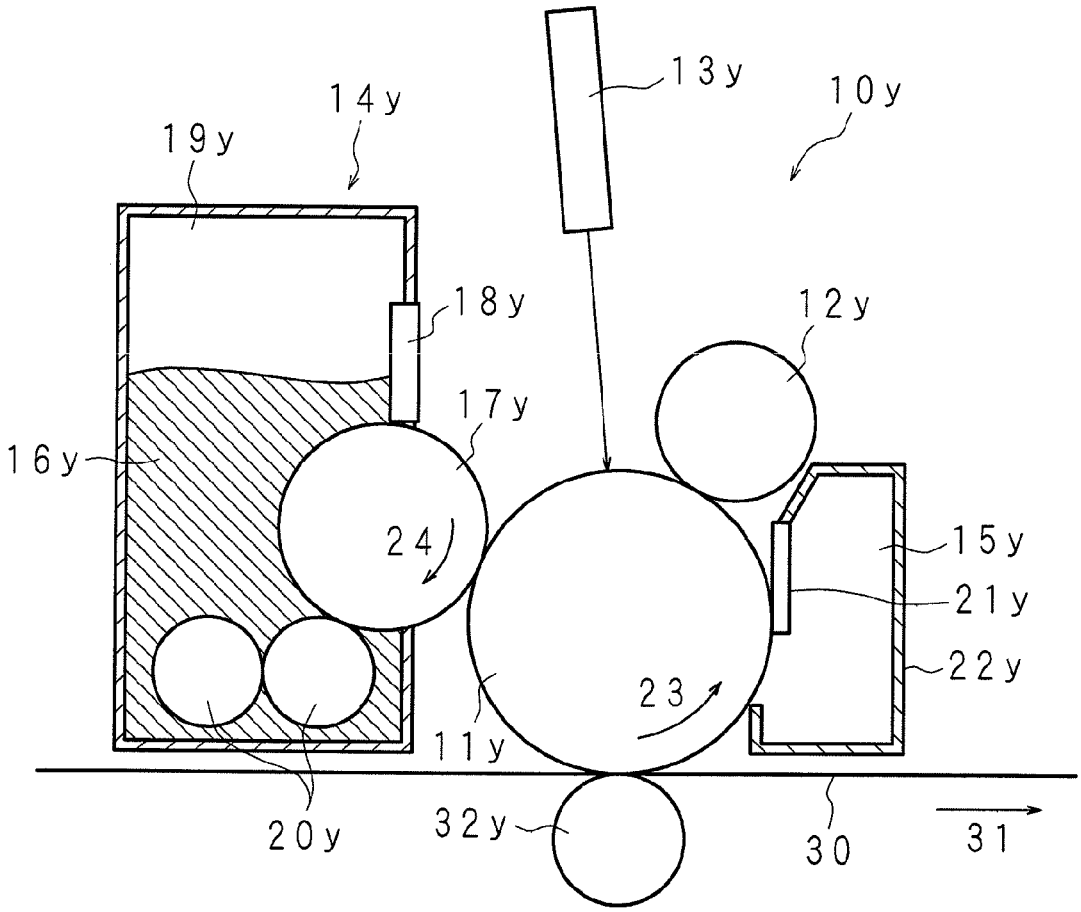
FIG. 2 is a schematic view illustrating a section of an image generating unit shown in FIG. 1.

FIG. 2 is a schematic view illustrating a section of the image generating unit 10*y*. The image generating unit 10*y* includes a photoreceptor drum 11*y*, a charge roller 12*y*, an optical scanning unit 13*y*, a developing device 14*y* and a drum cleaner 15*y*.

The photoreceptor drum 11*y* is an image carrier with a surface on which a yellow toner image is formed, is supported to be rotatably driven around its axis line, and includes a cylindrical, columnar or thin sheet-like (preferably cylindrical) conductive base and a photosensitive layer formed on the surface of the conductive base. A photoreceptor drum generally used in this field may be used for the photoreceptor drum 11*y*, for example, a photoreceptor drum including an aluminum element tube which is a conductive base and an organic photosensitive layer which is a photosensitive layer formed on the surface of the aluminum element tube, and connected to the GND (ground) potential may be used.

The organic photosensitive layer may be formed by laminating a charge generation layer including a charge generating substance and a charge conveyance layer including a charge conveying substance, or may be formed with single layer including a charge generating substance and a charge conveying substance. The thickness of the organic photosensitive layer is not particularly limited but may be, for example, 20 μm. Moreover, a foundation layer may be formed between the organic photosensitive layer and the conductive base. Furthermore, a protective layer may be formed on the surface of the organic photosensitive layer.

The charge roller 12*y* is a roller for charging the surface of the photoreceptor drum 11*y* to an electric potential of a predetermined polarity. As a means for charging the photoreceptor drum 11*y*, it is not limited to the charge roller 12*y*. A brush charger, a charger-type charging device, a corona charger of the scorotron type or the like may also be used in place of the charge roller 12*y*.

The optical scanning unit 13*y* is a unit for directing laser light controlled by the image information for yellow to the surface of the charged photoreceptor drum 11*y* to form an electrostatic latent image corresponding to the yellow image information on the surface of the photoreceptor drum 11*y*. A semiconductor laser device or the like may be used for the light source of the laser light.

The developing device 14*y* is a device provided facing of the photoreceptor drum 11*y* to develop and visualize the latent image formed on the surface of the photoreceptor drum 11*y*. The yellow toner out of the yellow toner and carrier included in a dual-component developer 16*y* in a developer tank 19*y* is carried on the surface of a developer sleeve 17*y*. The yellow toner is then regulated to be a layer of a predetermined thickness by a layer thickness regulating member 18*y* and conveyed to the surface of the photoreceptor drum 11*y*, where an electrostatic latent image formed thereon is developed and visualized. A feed roller 20*y* for feeding the developer to the developer sleeve 17*y* is also provided in the developer tank 19*y*. Note that a single-component developer without a carrier may also be used as the developer.

The drum cleaner 15*y* includes a cleaner blade 21*y* which is pressed to be in contact with the photoreceptor drum 11*y*. After the yellow toner image on the surface of the photoreceptor drum 11*y* is intermediately transferred to the intermediate transfer belt 30, the yellow toner remaining on the photoreceptor drum 11*y* without being transferred to the intermediate transfer belt 30 is removed by the cleaner blade 21*y* and collected in a box 22*y*.

Next, the operation of the image forming portion 2 will be described. The photoreceptor drum 11*y* is rotatably driven in a direction of an arrow 23 by a driving means (not shown in FIG. 2) at a peripheral velocity of, for example, 220 mm/s. The developer sleeve 17*y* is rotatably driven at a developer nip adjacent to the photoreceptor drum 11*y* in a direction of an arrow 24 which is the opposite direction of the rotating direction of the photoreceptor drum 11.

In the image generating unit 10*y*, the photoreceptor drum 11*y* is rotatably driven around its axis while a voltage of, for example, −1200V is applied to the charge roller 12*y* by a power supply (not shown) to discharge electricity, so as to charge the surface of the photoreceptor drum 11*y* to, for example, −600V. Next, laser light from the optical scanning unit 13*y*, controlled in accordance with the image information for yellow, is directed to the surface of the charged photoreceptor drum 11*y*, to form an electrostatic latent image at an exposure potential of −70V which is corresponding to the image information for yellow.

Subsequently, the surface of the photoreceptor drum 11*y* is made closer to the yellow toner held on the surface of the developer sleeve 17*y*. A direct current voltage of −450V is applied as the developing potential to the developer sleeve 17*y*. The difference in electric potential between the developer sleeve 17*y* and the photoreceptor drum 11*y* allows the yellow toner to be deposited to the latent image, and thus a yellow toner image is formed on the surface of the photoreceptor drum 11*y*. The yellow toner image is intermediately transferred to the intermediate transfer belt 30 which is pressed to be in contact with the surface of the photoreceptor drum 11*y* and is driven in the direction of the arrow 31, as will be described later. The yellow toner remaining on the surface of the photoreceptor drum 11 is removed and collected by the drum cleaner 15*y*. Subsequently, the operation of forming a yellow toner image is repeatedly executed likewise. Note that dual-component developers 16*y*, 16*m*, 16*c* and 16*b* used in the image forming apparatus 1 according to the present embodiment will be described later.

Configuration and Operation of Intermediate Transfer Portion 3

The intermediate transfer portion 3 includes the intermediate transfer belt 30, intermediate transfer rollers 32*y*, 32*m*, 32*c*, 32*b*, support rollers 33, 34, 35, a belt cleaner 36 and the like. In the present embodiment, the intermediate transfer portion 3 and a secondary transfer portion 4 described later serve to transfer an image to a recording medium 8. Note that each of the intermediate transfer portion 3 and secondary transfer portion 4 is configured to serve as a transfer portion for transferring an image formed with a developer onto a sheet based on obtained image data, as defined in the claims.

The intermediate transfer belt 30 is an image carrier having the shape of an endless belt which is stretched over the support rollers 33, 34 and 35 to form a loop-like moving path. The intermediate transfer belt 30 is driven at approximately the same peripheral velocity as the photoreceptor drums 11*y*, 11*m*, 11*c* and lib in the direction of the arrow 31, i.e., so driven that the image carrying surface facing each of the photoreceptor drums 11*y*, 11*m*, 11*c* and 11*b* moves from the photoreceptor drum 11*y* to the photoreceptor drum 11*b*.

For the intermediate transfer belt 30, a polyimide film with a thickness of, for example, 100 μm may be used. A film made of synthetic resin such as polycarbonate, polyamide, polyester and polypropylene or various types of rubber may alternatively be used as the material for the intermediate transfer belt 30, not limited to polyimide.

A conductive material such as furnace black, thermal black, channel black and graphite carbon may be contained in the film formed of synthetic resin or various types of rubber, in order to adjust an electric resistance value of the intermediate transfer belt 30. Moreover, a coating layer formed with a fluorine resin composition or fluorine rubber with low adherence to toner may also be provided. Examples of the material constituting the coating layer include polytetrafluoroethylene (PTFE) and a copolymer of tetrafluoroethylene and perfluoroalkyl vinyl ether (PFA). A conductive material may also be contained in the coating layer.

The intermediate rollers 32*y*, 32*m*, 32*c* and 32*b* are roller members arranged to be opposed to the photoreceptor drums 11*y*, 11*m*, 11*c* and 11*b*, respectively, with the intermediate transfer belt 30 interposed in between, each of which being pressed to be in contact with the opposite surface of the image carrying surface on the intermediate transfer belt 30 and rotatably driven around their axes by a driving means (not shown).

For each of the intermediate transfer rollers 32*y*, 32*m*, 32*c* and 32*b*, a roller member is used, which includes, for example, a metal shaft and a conductive layer formed on the surface of the metal shaft. The metal shaft is configured with, for example, metal such as stainless steel. Though not particularly limited, the diameter of the metal shaft is preferably between 8 mm and 10 mm inclusive. The conductive layer is configured with an elastic body having conductivity. As the conductive elastic body, a material generally used in this field, for example, ethylene-propylene rubber (EPDM), EPDM foam and urethane foam, including a conductive agent such as carbon black, may be used. The conductive layer allows the intermediate transfer belt 30 to be uniformly applied with high voltage.

Each of the intermediate transfer rollers 32*y*, 32*m*, 32*c* and 32*b* is applied with intermediate transfer bias having a polarity opposite to the charge polarity of toner by constant voltage control in order to transfer the toner image formed on the surface of each of the photoreceptor drums 11*y*, 11*m*, 11*c* and 11*b* onto the intermediate transfer belt 30. Accordingly, the toner images of yellow, magenta, cyan and black formed on the photoreceptor drums 11*y*, 11*m*, 11*c* and 11*b* are sequentially transferred and layered one on top of the other on the image carrying surface of the intermediate transfer belt 30, forming a multi-color toner image. If, however, the image information for only one or some of the colors of yellow, magenta, cyan and black is input, only the image generating unit(s) 10 corresponding to the color(s) for the input image information among the image generating units 10*y*, 10*m*, 10*c* and 10*b* is/are used to form a toner image.

The support rollers 33, 34 and 35 are provided to be rotatably driven around their axes by a driving means (not shown), to stretch the intermediate transfer belt 30 with tension to rotatably drive the belt 30 in the direction of the arrow 31. For each of the support rollers 33 and 35, an aluminum cylinder (pipe-like roller) with a diameter of 30 mm and a thickness of 1 mm, for example, is used. The support roller 34 among them is pressed to the secondary transfer roller 40 described later with the intermediate transfer belt 30 interposed in between, to form a secondary transfer nip, and is electrically grounded.

The belt cleaner 36 is a member for removing toner remaining on the image carrying surface after the toner image on the image carrying surface of the intermediate transfer belt 30 is transferred to the recording medium 8 at the secondary transfer portion 4 described later. The belt cleaner 36 is arranged to be opposed to the support roller 35 with the intermediate transfer belt 30 interposed in between.

The operation of the intermediate transfer portion 3 will now be described. The image carrying surface of the intermediate transfer belt 30 is pressed to be in contact with the photoreceptor drums 11*y*, 11*m*, 11*c* and 11*b* in this order from the upstream side in the driving direction of the intermediate transfer belt 30. The position at which the intermediate transfer belt 30 is pressed to each of the photoreceptor drums 11*y*, 11*m*, 11*c* and 11*b* will be the intermediate transfer position for each toner image.

The intermediate transfer rollers 32*y*, 32*m*, 32*c* and 32*b* are uniformly applied with high voltage having a polarity opposite to the charge polarity of toner. Such an application of high voltage allows the toner images formed on the photoreceptor drums 11*y*, 11*m*, 11*c* and 11*b* to be layered and intermediately transferred at predetermined positions on the image carrying surface of the intermediate transfer belt 30. Thus, a multi-color toner image is formed on the intermediate transfer belt 30. The toner image is secondarily transferred to the recording medium 8 at the secondary transfer nip, as will be described later. After the secondary transfer, the toner remaining on the image carrying surface of the intermediate transfer belt 30, paper dust and the like are removed by the belt cleaner 36, and a multi-color toner image is transferred again to the image carrying surface of the intermediate transfer belt 30.

Configuration and Operation of Secondary Transfer Portion 4

The secondary transfer portion 4 includes the support roller 34 and a secondary transfer roller 40. The support roller 34 has a function of supporting and stretching the intermediate transfer belt 30 as well as a function of secondarily transferring the multi-color toner image on the intermediate transfer belt 30 to the recording medium 8. The secondary transfer roller 40 is a roller member which is pressed to the support roller 34 through the intermediate transfer belt 30 while rotatably driven around its axis.

The secondary transfer roller 40 includes, for example, a metal shaft and a conductive layer formed on the surface of the metal shaft. The metal shaft is formed with, for example, metal such as stainless steel. The conductive layer is formed with an elastic body or the like having conductivity. As the conductive elastic body, a material generally used in this field, for example, EPDM, EPDM foam and urethane foam including a conductive material such as carbon black may be used. The secondary transfer roller 40 is connected to a power supply (not shown) and is uniformly applied with high voltage having a polarity opposite to the charge polarity of toner.

Next, the operation of the secondary transfer portion 4 is described. The press-contact portion of the support roller 34, intermediate transfer belt 30 and secondary transfer roller 40 forms the secondary transfer nip. The recording medium 8 fed from a recording medium feeder 5, which will be described later, is conveyed to the secondary transfer nip in synchronization with the conveyance of the toner image on the intermediate transfer belt 30 to the secondary transfer nip. The multi-color toner image is layered on the recording medium 8 at the secondary transfer nip. A high voltage is then applied to the secondary transfer roller 40 to secondarily transfer a to-be-fixed toner image to the recording medium 8. The recording medium 8 carrying the to-be-fixed toner image is then conveyed to the fusing unit 6.

Configuration and Operation of Recording Medium Feeder 5

The recording medium feeder 5 is configured by a carry-out roller 51 for carrying out the recording medium 8 contained in the housing tray 50, conveyance rollers 52*a*, 52*b*, a conveyer path P and the like. Note that the recording medium 8 may be a printing paper or another film-like recording medium such as an Overhead Projector (OHP) sheet.

The operation of the recording medium feeder 5 is now described. The housing tray 50 houses the recording medium 8, while the carry-out roller 51 carries out the recording medium 8 contained in the housing tray 50. The conveyance rollers 52*a* and 52*b* carry the carried-out recording medium 8 to the secondary transfer portion 4.

Configuration and Operation of Fuser portion 6

Figure 3:
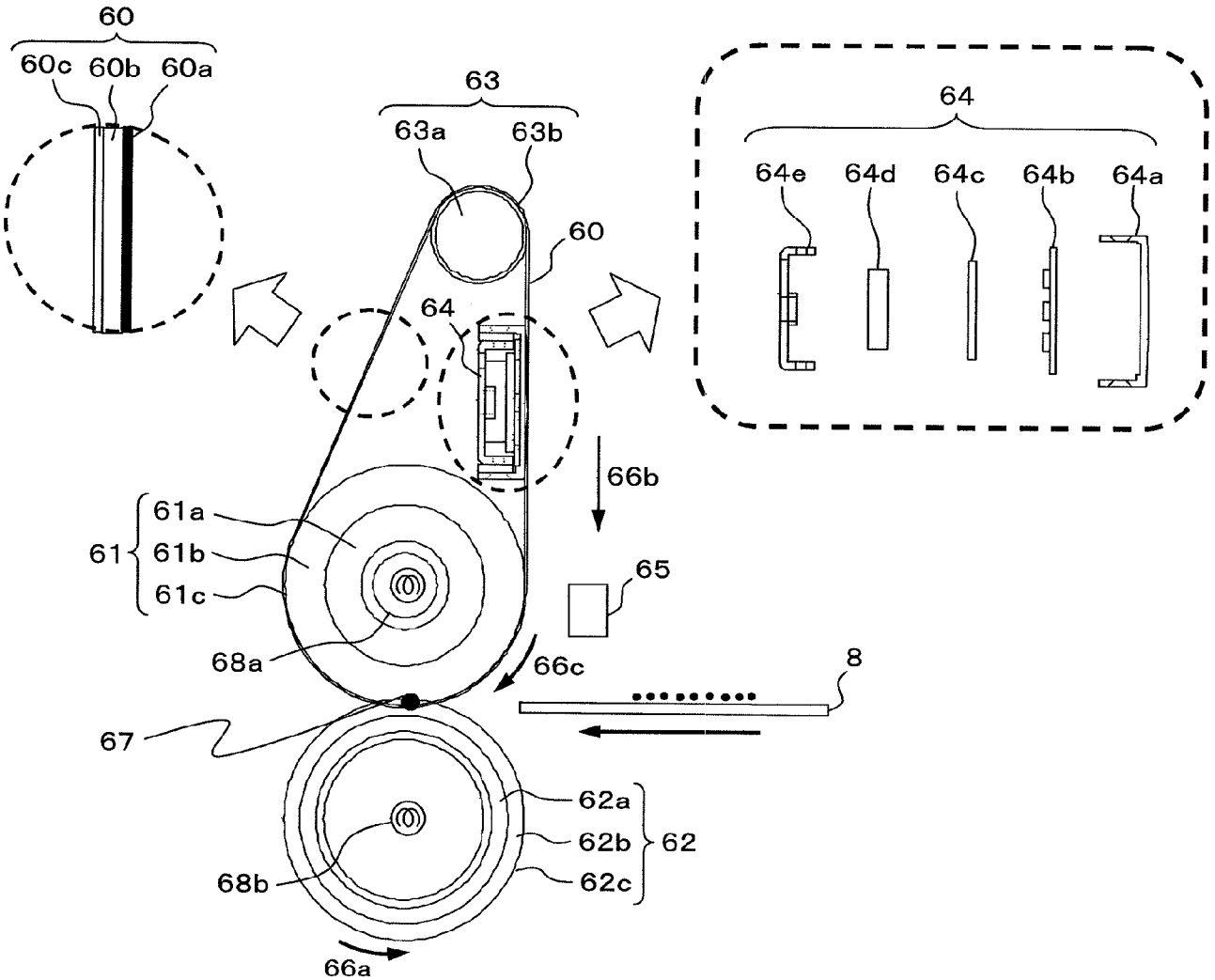
FIG. 3 is a schematic view illustrating a section of a fuser portion shown in FIG. 1.

FIG. 3 is a schematic view illustrating a section of the fuser portion 6. The fuser portion 6 is configured by a fuser belt 60, a fuser roller 61, a pressure roller 62, a tension roller 63, a heater unit 64, a thermistor 65 and the like. Here, the heater unit 64 is configured to serve as a heater for heating the fuser belt, which is defined in claims. Moreover, the thermistor 65 is configured to serve as a detector for detecting the temperature of the fuser belt, which is defined in claims.

The fuser belt 60 is an endless belt member stretched over the fuser roller 61 and the tension roller 63 with tension to form a loop-like moving path. Furthermore, the fuser belt 60 is arranged at the pressure contact point of the fuser roller 61 and pressure roller 62 so as to be in contact with the pressure roller 62, and heats and fuses the toner forming the toner image carried on the recording medium 8 to fix the toner image on the recording medium 8. The fuser belt 60 is rotatably driven in the direction of an arrow 66*b* along with the rotation of the pressure roller 62 driven in the direction of an arrow 66*a*.

The fuser belt 60 has a three-layer structure including a base layer 60*a*, an elastic layer 60*b* and a release layer 60*c*. In the embodiment described later, an endless belt is used, which is formed to have three layers and to have the shape of a cylinder with the diameter of 50 mm. The material for forming the base layer 60*a* is not particularly limited if the material has preferable heat resistance and endurance. Heat-resistant synthetic resin, preferably polyimide (PI) or polyamideimide (PAI) may be used in addition to nickel electrocast, stainless steel or the like. These materials have high strength and heat-resistance, and are also inexpensive. Furthermore, though not particularly limited, the thickness of the base layer 60*a* is preferably between 30 μm and 200 μm inclusive.

The material forming the elastic layer 60*b* is not particularly limited as long as it has rubber elasticity. It is, however, preferable to use a material with higher heat resistance. Specific examples of such materials include silicone rubber, fluorine-contained rubber, fluorosilicone rubber and the like. Among them, silicone rubber which is especially elastic is preferably used. The hardness of the elastic layer 60*b* preferably corresponds to the JIS-A hardness of 1 to 60. The JIS-A hardness in this range can prevent lowering in strength and adherence of the elastic layer 60*b* while avoiding insufficient fixing of toner. Examples of the silicone rubber include silicone rubber of one component or two, three or more components, silicone rubber of Low Temperature Vulcanization (LTV) type, Room Temperature Vulcanization (RTV) type or High Temperature Vulcanization (HTV) type, and condensation or addition silicone rubber.

Furthermore, the thickness of the elastic layer 60*b* may preferably be between 100μm and 200μm inclusive. With a thickness in this range, the heat insulating property can be maintained low, while the elastic effect of the elastic layer 60*b* can be maintained, thereby achieving an energy saving effect. In the embodiment described later, silicone rubber with the JIS-A hardness of 5 is used.

The release layer 60*c* is made of a layer formed with, for example, a fluorine-contained resin tube, or a layer formed by applying resin containing fluorine-contained resin to the elastic layer 60*b* and firing it. The material for the fluorine-contained resin is not particularly limited if it has a preferable heat resistance and endurance and low adherence to toner, and includes, for example, polytetrafluoroethylene (PTFE) and a copolymer of tetrafluoroethylene and perfluoroalkyl vinyl ether (PFA). The thickness of the release layer 60*c* is preferably between 5μm and 50μm inclusive. With the thickness in this range, it is possible to conform microscopic irregularity of the recording medium, while the elasticity of the elastic layer 60*b* can be realized with an appropriate strength.

The fuser roller 61 is a roller member supported by a supporting means (not shown) so as to be freely rotatable, and rotates at a predetermined speed in the direction of an arrow 66*c* along with the rotation of the pressure roller 62 and fuser belt 60. The fuser roller 61 includes a core bar 61*a* and an elastic layer 61*b*. In the embodiment described later, the roller member formed to have a cylindrical shape with the outer diameter of 30 mm is used. For the metal forming the core bar 61*a*, metal having high thermal conductivity, for example, aluminum, iron and the like may be used.

Though the material for forming the elastic layer 61*b* is not particularly limited as long as it has rubber elasticity, a material with higher heat resistance is preferably used. Specific examples of such material include silicone rubber, fluorine-contained rubber, fluorosilicone rubber and the like. Among them, thermoset liquid silicone rubber is especially preferred. Moreover, the elastic layer 61*b* is preferably porous in order to increase the heat insulating property of the fuser roller 61.

Furthermore, a surface layer 61*c* is formed on the elastic layer 61*b* in order to correct a bias in the fuser belt 60. This is because the surface layer 61*c* allows the surface of the fuser roller 61 to be more easily slidable, facilitating the correction of a bias in the fuser belt 60. The material for forming the surface layer 61*c* is not particularly limited if it has high heat resistance and endurance and can easily be slidable, and preferably includes, for example, fluorine-contained resin material or fluorine-contained rubber such as a copolymer of tetrafluoroethylene and perfluoroalkyl vinyl ether (PFA) and polytetrafluoroethylene (PTFE).

In addition, an auxiliary heater 68*a* may be provided inside the fuser roller 61. This is to shorten the start-up time, i.e. from the time when the image forming apparatus 1 is turned on to the time when it is ready for image forming, and to prevent lowering in temperature at the surface of fuser roller 61 due to the heat transfer to the recording medium 8 when the toner image is fixed. A halogen heater or the like is used for the heater 68*a*.

The pressure roller 62 is pressed to the fuser roller 61 through the fuser belt 60 by a pressure means (not shown) at a more downstream side in the rotating direction of the fuser roller 61 than the lowest point of the fuser roller 61 in the perpendicular direction, to form a fuser nip 67. The pressure roller 62 is rotatably driven by a driving means (not shown). The pressure roller 62 presses fused toner to the recording medium 8 at heating and fixing of the toner image by the fuser roller 61 to the recording medium 8, to help the toner image better be fixed to the recording medium 8.

The pressure roller 62 is configured to include a core bar 62*a*, an elastic layer 62*b* and a surface layer 62*c*. In the embodiment described later, a roller member with the outer diameter of 30 mm is used. For the material forming the core bar 62*a*, elastic layer 62*b* and surface layer 62*c*, metal or other materials used for forming the core bar 61*a*, elastic layer 61*b* and surface layer 61*c* of the fuser roller 61 may also be used. Moreover, the shape of the core bar 62*a* is similar to the shape of the core bar 61*a* in the fuser roller 61.

In addition, an auxiliary heater 68*b* may be provided inside the pressure roller 62. This is to shorten the start-up time, i.e. from the time when the image forming apparatus 1 is turned on to the time when it is ready for image forming, and to prevent lowering in temperature at the surface of fuser roller 61 due to the heat transfer to the recording medium 8 when the toner image is fixed. A halogen lamp or the like is used for the heater 68*b*.

The tension roller 63 is a roller member supported to be freely rotatable such that tension is applied to the fuser belt 60 by a pressure means (not shown). The tension roller 63 rotates along with the rotation of the fuser belt 60 in the direction of the arrow 66*b*. The tension roller 63 has a cylindrical body with two-layered structure including a core bar 63*a* and a thermal insulation layer 63*b*. For the core bar 63*a*, a roller member made of metal or carbon fiber which has high Young's modulus and high resistance to flexure, such as iron or stainless steel may be used. In the embodiment described later, a roller with a diameter of 20 mm is used. Note that the thermal insulation layer 63*b* is configured to serve as a thermal insulation member as defined in claims.

The thermal insulation layer 63*b* is provided to cover the surface of the core bar 63*a* in order to prevent heat from transferring to the core bar 63*a*. To enhance the heat insulating effect by the thermal insulation layer 63*b*, the thermal insulation layer 63*b* is preferably porous. The material used for the thermal insulation layer 63*b* may be a material with high heat insulating property, for example, a ceramic material, porous silicone rubber, fluorine rubber or fluorosilicone rubber. Though a porous material with open cells or closed cells may be used, the closed-cell porous material is preferred in order to suppress deformation due to tension. In the embodiment described later, a silicone sponge is used as the thermal insulation layer 63*b*, which covers the core bar 63*a*.

The heater unit 64 is a unit, which is arranged inside the orbit around which the fuser belt 60 revolves, has a heating source inside thereof, and is pressed to be in contact with the fuser belt 60 by a pressure means (not shown) to heat the fuser belt 60. The heater unit 64 includes a heat transmission member 64*a*, a planar heat generator 64*b*, a thermal insulation member 64*c*, a press member 64*d* and a reinforcement member 64*e*.

The heat transmission member 64*a* is a member for transmitting heat generated by the planar heat generator 64*b* to the fuser belt 60. Though the material for the heat transmission member 64 is not particularly limited if it has heat resistance and high thermal conductivity, metal such as aluminum or iron may preferably be used. Moreover, to attach the heat transmission member 64*a* to a support member (not shown), the heat transmission member 64*a* preferably has a laterally-facing U-shape with flanges provided at the top and bottom as shown in FIG. 3.

The surface of the heat transmission member 64*a* preferably has the shape of a circular arc so as to slidably be in contact with the inner surface of the fuser belt 60. The fuser belt 60 may, however, not be able to follow the shape of the heat transmission member 64*a* if the curvature is large, causing such a problem that the fuser belt 60 is lifted away from the heat transmission belt 60 at the central part of the heat transmission member 64*a*. Thus, the radius of the curvature of the heat transmission member 64*a* is preferably in the range between R10 mm and R200 mm inclusive. It is also possible to form a fluorine-contained resin layer on the surface of the heat transmission member 64*a* as needed in order for the inner surface of the fuser belt 60 to preferably slide over the heat transmission member 64*a*.

Figure 4:
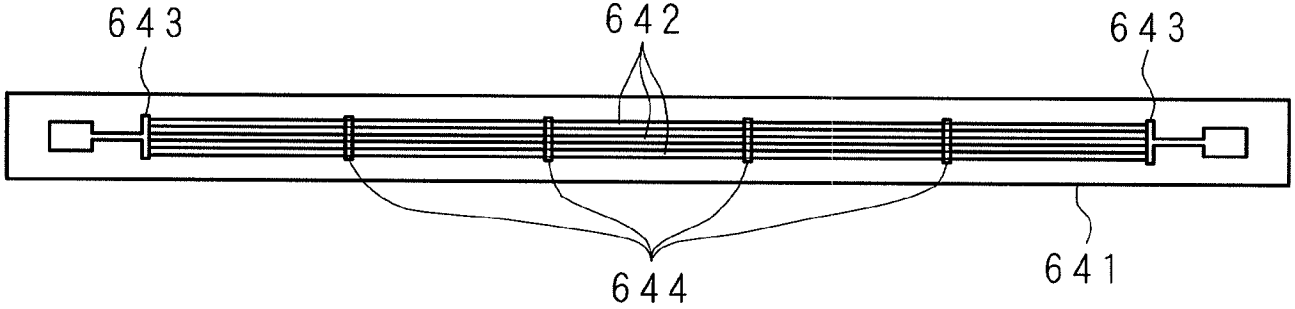
FIG. 4 is a front view of a planar heat generator shown in FIG. 3.

FIG. 4 is a front view of the planar heat generator 64*b*. The planar heat generator 64*b* shown in FIG. 4 is formed with plural resistance heating elements 642 including silver-palladium (AgPd) and the like formed on the insulation substrate 641 such as ceramic having the shape of rectangular strip in planar view. The material for the insulation substrate 641 is not particularly limited but any material with high heat resistance and heat conductivity as well as electrical insulating properties, for example, a ceramic material such as alumina and aluminum nitride may be used. Moreover, a metal material and the like such as stainless steel coated with glass material with high heat resistance and electrical insulating properties may also be used. In the embodiment described later, a stainless steel substrate coated with a glass material having a length of 366 mm, a width of 15.8 mm and a thickness of 0.6 mm is used.

In FIG. 4, the resistance heating elements 642 are provided as three linear patterns. A shared terminal electrode 643 is provided for connecting one end to the other end of each resistance heating element 642, while conducting portions 644 for stabilizing the resistance value in the longitudinal direction are provided between the terminal electrodes 643. The patterns of resistance heating elements 642 are formed with silver-palladium paste on the insulation substrate 641 and the patterns of terminal electrode 643 and conducting portions 644 are formed with silver paste, and thereafter fired with a predetermined firing condition at a firing furnace. After firing, an insulation material such as glass material is used to coat the surface of the resistance heating elements 642 as an insulated protective layer, to form a planar heat generator 64*b*. Each of the resistance heating elements 642 and conducting portions 644 in the embodiment described later are layers having the thickness of approximately 10μm, and each resistance heating element 642 has a length of 320 mm.

The thermal insulation member 64*c* is a member arranged to prevent the heat at the planar heat generator 64*b* from spreading through the press member 64*d*. The material for the heating member 64*c* is not particularly limited as long as it has high heat resistance and heat insulating properties, and for example, a foamed polyimide sheet or an aramid sheet may be used.

The press member 64*d* is a member arranged to press the planar heat generator 64*b* toward the heat transmission member 64*a* through the thermal insulation member 64*c*. The press member 64*d* may preferably be made of a hard material with high heat resistance, and thus, aluminum, a hard resin material or the like is used.

The reinforcement member 64*e* is a member for preventing the heater unit 64 from bending when the heater unit 64 is pressed to the fuser belt 60, and for sandwiching the planar heat generator 64*b*, thermal insulation member 64*c* and press member 64*d* between the heat transmission member 64*a* and the reinforcement member 64*e*. The reinforcement member 64*e* may preferably be made of metal such as iron, though not particularly limited if it has high rigidity and heat resistance.

As shown in FIG. 3, plural screw holes are opened at flanges arranged at the top and bottom of the heat transmission member 64*a*, and screws are used to fasten the heat transmission member 64*a* with the reinforcement member 64*e*, such that the heat transmission member 64*a* and the reinforcement member 64*e* are connected with each other. They can be connected at several positions in the longitudinal direction, preventing the heat transmission member 64*a* from having localized lowering in temperature and suppressing deflection of the heat transmission member 64*a*. This can further prevent unevenness in the pressure force applied to the fuser belt 60.

The thermistor 65 is arranged adjacent to the fuser belt 60 at a position more downstream in the rotation direction than a position at which the heater unit 64 is pressed to the fuser belt 60 and more upstream than a position at which the fuser belt 60 touches the pressure roller 62, to detect the temperature of the fuser belt 60.

Next, the operation of the fuser portion 6 is described. The fuser portion 6 operates by the drive and temperature control performed by the control portion described earlier (not shown). The control portion is configured by a Central Processing Unit (CPU) (not shown), a Read Only Memory (ROM) storing a control program to be executed by the CPU, and so forth. The CPU reads out a drive and temperature control program from the ROM and executes it, for the control portion to perform drive and temperature control of the fuser portion 6.

The control portion performs temperature control to raise the temperature of the fuser portion 6 in response to a trigger, that is, for example, the detection that the power button of the image forming apparatus 1 is pressed to turn it on or that an instruction to form an image in the image forming apparatus 1 is accepted. Here, the instruction to form an image is input from an operation portion arranged on the upper surface of the image forming apparatus 1, or from an external device such as a computer connected to the image forming apparatus 1.

The control portion sends out a control signal for supplying electric power to the heater unit 64, the heater 68*a* provided inside the fuser roller 61 and the heater 68*b* provided inside the pressure roller 62 to a power supply (not shown). The power supply which has received the control signal from the control unit supplies power to the heater unit 64, heaters 68*a* and 68*b*, each of which generates heat, to raise the temperature of the fuser portion 6. When finding that the temperature detected by the thermistor 65 reaches the set temperature, the control portion performs ON/OFF control of the power supplied from the power supply to the heater unit 64, heaters 68*a* and 68*b* so as to maintain the temperature detected by the thermistor 65 at the set temperature.

Subsequently, the control portion rotates the pressure roller 62 in the direction of the arrow 66*a* by a driving means. Along with the rotation of the pressure roller 62, the fuser belt 60, fuser roller 61 and tension roller 63 are driven to be rotated. In this state, the recording medium 8 carrying a to-be-fixed toner image is conveyed from the secondary transfer roller 40 (see FIG. 1) to the fuser nip 67. While the recording medium 8 passes through the fuser nip 67, the toner forming the toner image is heated and pressurized to be fixed to the recording medium 8, thereby forming an image.

In the case where no heaters 68*a* and 68*b* are provided in order to reduce power consumption and the number of components, the heater unit 64 heats the fuser belt 60, and the heat transferred from the fuser belt 60 indirectly raises the temperature of the fuser roller 61 and pressure roller 62.

The time period (warm-up time) required from the time when the heater unit 64, heaters 68*a* and 68*b* of the fuser portion 6 is supplied with power and starts temperature raising operation to the time when the temperature of the thermistor 65 reaches the set temperature depends on the thermal capacity of the entire fuser portion 6. In general, the warm-up time is longer if the thermal capacity of the entire fuser portion 6 is large, whereas it is shorter if the thermal capacity of the entire fuser portion 6 is small.

As described above, to suppress the thermal capacity of the entire fuser portion 6 in the configuration including the fuser roller 61, tension roller 63 and heater unit 64 inside the orbit in which the fuser belt 60 revolves, the tension roller 63 may be configured to have a small diameter to reduce the thermal capacity thereof. When, however, the diameter of the tension roller 63 is made small, the rigidity of the tension roller 63 becomes insufficient if it is made to have a hollow center (cylindrical shape), causing a deflection due to the tension applied.

In order to suppress the deflection occurring at the tension roller 63 with a small diameter, it is necessary to increase the thickness of the core bar 63*a* or make it solid. If the core bar 63*a* is increased in thickness or made solid, the tension roller 63 will have a larger thermal capacity. According to the present invention, therefore, the thermal insulation layer 63*b* is provided to suppress thermal conduction from the side of the fuser belt 60 to the side of the tension roller 63, so that the temperature of the fuser portion 6 can be raised in a short period of time. Thus, the warm-up time can be shortened and the fuser portion 6 can be reduced in size because of the reduced diameter of the tension roller 63.

As for the outer diameter of the tension roller 63, when the outer diameter of tension roller 63 is represented by "r" while the outer diameter of the fuser roller 61 is represented by "R," at least the fuser portion 6 can be reduced in size by making the diameter r smaller than the diameter R. It is, however, desirable to satisfy the relational expression indicated below.

$$r \leq \tfrac{2}{3} \times R.$$

If the outer diameter r exceeds the value of the above relational expression, the diameter r of the tension roller 63 is large enough for the tension roller 63 to have a sufficient strength to distortion even if the core bar 63*a* is made with a reduced thickness. Because the thermal capacity can be reduced by the reduced thickness of the core bar 63*a*, the warm-up time can be shortened if the surface of the tension roller 63 is covered with the thermal insulation layer 63*b*. The effect of shortened warm-up time is, however, limited.

If the outer diameter r satisfies the above relational expression, the tension roller 63 can have a sufficient strength to distortion only when the core bar 63*a* is made thicker or solid. The thermal capacity of the tension roller 63 is increased by the increased thickness of the core bar 63*a*, the effect of shortening the warm-up time by covering the surface of the tension roller 63 with the thermal insulation layer 63*b* is increased.

Embodiments

For the shortening effects of the warm-up time with various kinds of tension rollers 63, the result of consideration will now be described with respect to specific embodiments. Three types of embodiments including Example 1, Example 2 and Comparative Example are used. First, the configuration common to the three examples is described. The fuser belt 60 has a three-layer structure including a base layer 60*a*, an elastic layer 60*b* and a release layer 60*c*, uses an endless belt formed to have a cylindrical shape with the outer diameter of 50 mm. The elastic layer 60*b* in particular uses silicone rubber having the JIS-A hardness of 5.

The fuser roller 61 has a configuration including the core bar 61*a* and elastic layer 61*b*, and is formed of a roller member having a cylindrical shape with an outer diameter of 30 mm. The pressure roller 62 includes the core bar 62*a*, elastic layer 62*b* and surface layer 62*c*, and is formed of a roller member with an outer diameter of 30 mm. The heater unit 64 uses, as the planar heat generator 64*b*, a stainless board having a length of 366 m, thickness of 15.8 mm and thickness of 0.6 mm coated with glass material, and includes the resistance heating element 642 and conducting portion 644 each being a layer having a thickness of approximately 10 μm, the resistance heating element 642 having the length of 320 mm. The fuser belt 60, fuser roller 61, pressure roller 62 and heater unit 64 are common to the three examples.

Next, the configuration different from each other in the three examples will be described. As for the roller diameter of the tension roller 63, the outer diameter is 12.3 mm (which will be approximately 12.0 mm due to tension of the fuser belt 60 when attached to the fuser portion 6) in Example 1, 14.0 mm in Example 2 and 12.0 mm in Comparative Example. Moreover, the tension roller 63 in Examples 1 and 2 has the core bar 63*a* and thermal insulation layer 63*b* (silicone sponge), while that in Comparative Example only has the core bar 63*a* (carbon steel tube for machine structural use: STKM (JIS-G-3445), for example)

Figure 5:
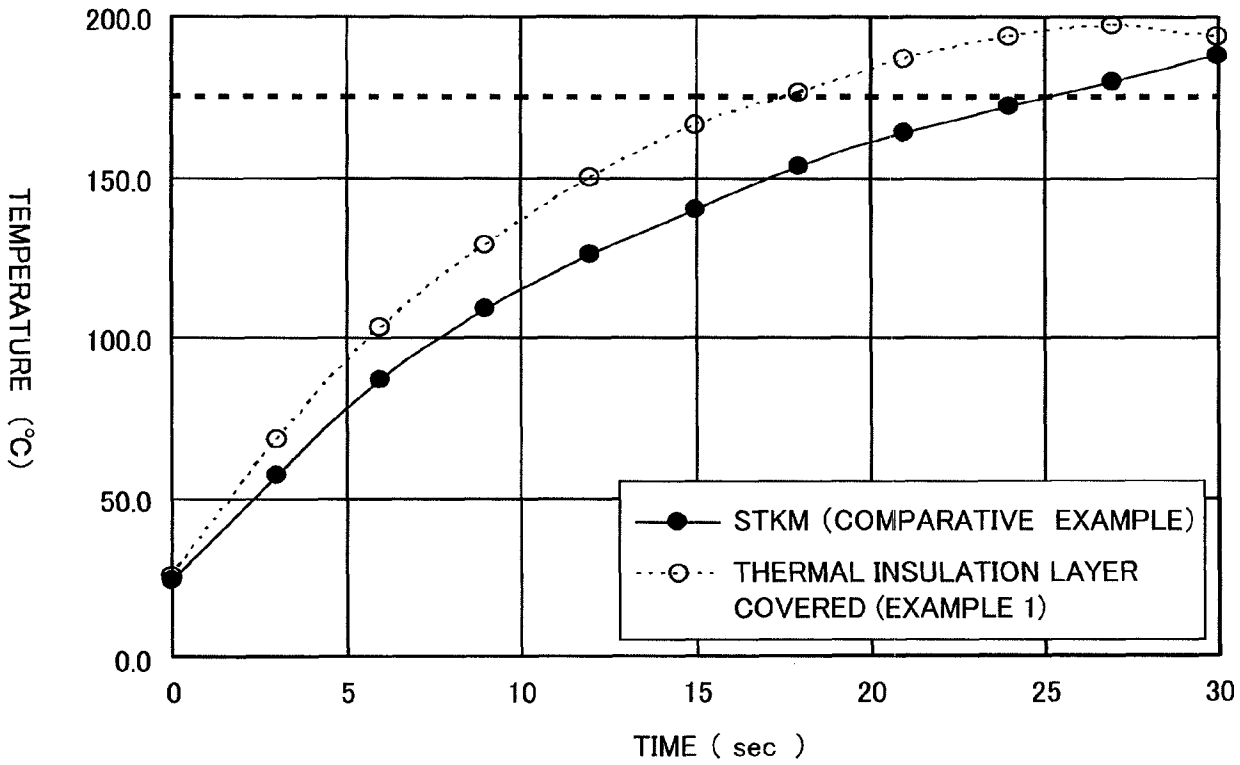
FIG. 5 is a graph illustrating changes in temperature at a warm-up.

The warm-up is determined to be completed at the time point when the fuser belt 60 reaches 175° C. The test results for the three examples are shown in FIGS. 5 and 6. FIG. 5 is a graph illustrating changes in temperature at warm-up, and FIG. 6 is a chart illustrating warm-up time in each example. As shown in FIG. 5, Example 1 where the tension roller 63 is formed with the core bar 63*a* and thermal insulation layer 63*b* is warmed up faster than the comparative example where the tension roller 63 is formed only with the core bar 63*a*. It can also be seen that the temperature of the fuser belt 60 is raised in a shorter time by suppressing thermal conduction at the tension roller 63 with the thermal insulation layer 63*b*. As shown in FIG. 6, though the tension rollers 63 have different outer diameters in Examples 1 and 2, either of them has the thermal insulation layer 63*b*, showing a shorter warm-up time compared to Comparative Example having no thermal insulation layer 63*b*.

Description of Toner

Dual-component developers 16*y*, 16*m*, 16*c* and 16*b* used in the image forming apparatus 1 according to the present embodiment will be described below in detail. Each of the dual-component developers 16*y*, 16*m*, 16*c* and 16*b* includes toner and a carrier.

The toner is configured with toner particles containing binder resin, colorant and releasing agent. For the binder resin, material generally used in this field, for example, polystyrene, homopolymer of styrene substitute, styrene copolymer, polyvinyl chloride, polyvinyl acetate, polyethylene, polypropylene, polyester, and polyurethane may be used. One type of binder resin may independently be used, or two or more types of binder resin may be used together.

Among these types of binder resin, binder resin having a softening point of 100 to 150° C. and a glass transition point of 50 to 80° C. is preferable for the color toner in terms of preservation and endurance, and polyester which has the softening point and the glass transition point in the above-described ranges is particularly preferable. Polyester exhibits high transparency in the softened or melted state. The polyester used as binder resin will be transparent when a multicolor toner image including yellow, magenta, cyan and black toner images layered on top of another is fixed to the recording medium 8 at the fuser portion 6 described later, achieving sufficient color development by subtractive color mixing.

For the colorant, toner pigments and dyes that are conventionally used in the image forming technique of electrophotography may be used. Examples of the toner pigments include: an organic pigment such as azo pigment, benzimidazolon pigment, quinacridone pigment, phthalocyanine pigment, isoindolinone pigment, isoindoline pigment, dioxazine pigment, anthraquinone pigment, pelylene pigment, pelynone pigment, thioindigo pigment, quinophthalone pigment, and metal complex pigment; an inorganic pigment such as carbon black, titanium oxide, molybdenum red, chrome yellow, titanium yellow, chrome oxide, and Berlin blue; and metal powder such as aluminum powder. A single type of the toner pigment can independently be used, or two or more types can be used together.

As the release agent, wax may be used for example. Wax generally used in this technical field, for example, polyethylene wax, polypropylene wax, and paraffin wax can be used.

The toner may contain one type or two or more types of general toner addition agent, such as charge control agent, flow improver, fusing accelerator, and conductive agent, in addition to the binder resin, colorant and release agent.

The toner can be manufactured by a known method such as a pulverizing method, suspension polymerization method, or emulsion aggregation method. In the pulverizing method, the colorant and release agent are fused and mixed with the binder resin, and the resultant is pulverized to form the toner. In the suspension polymerization method, monomers of the binder resin, colorant and release agent are uniformly dispersed, and the monomers are polymerized to form the toner. In the emulsion aggregation method, the binder resin, colorant and release agent are aggregated by an aggregating agent, and fine particles of the obtained aggregated substance are heated to form the toner.

Though the volume average particle diameter of the toner is not particularly limited, it is preferably within a range between 2 μm and 7 μm inclusive. When the volume average particle diameter of the toner is appropriately small as described above, the coverage of the toner to the recording medium 8 is increased. This enables enhancement in image quality and reduction in the amount of consumption of toner with a small amount of deposited toner.

If the volume average particle diameter of the toner is less than 2 μm, the fluidity of the toner is reduced, hindering sufficient supply, stirring and charging of the toner during development. This causes a lack of the toner supplied to the photoreceptor drum 11, or increase in the toner having a reverse polarity, possibly preventing formation of a high-quality image. If the volume average particle diameter of the toner exceeds 7 μm, the number of toner particles with large diameters is increased. Such large toner particles are difficult to be softened up to the central parts during the fusing operation, deteriorating the fixing of the toner image to the recording medium 8 and the color development of the image. The color of the image becomes dull, particularly in the case where the toner is fixed to an OHP sheet.

The toner used in the image forming apparatus 1 according to the present embodiment corresponds to insulating non-magnetic toner of a negative polarity having a glass transition point of 60° C., a softening point of 120° C. and a volume average particle diameter of 6 μm. In order to obtain an image density of 1.4 in a reflecting density value measured by 310 manufactured by X-Rite Co., Ltd. with the use of the toner, a toner amount of 5 g/m$^2$ is required on the surface of the recording medium 8. The toner contains polyester having a glass transition point of 60° C. and the softening point of 120° C. as the binder resin, and contains pigments of the respective colors corresponding to 12 wt. % of the total amount of the toner as the colorant. The toner also contains low-molecular polyethylene wax having a glass transition point of 50° C. and a softening point of 70° C. as the release agent in an amount of 7 wt. % with respect to the total amount of the toner. The low-molecular polyethylene wax used as the release agent in the toner has a glass transition point and a softening point lower than those of the polyester used as the binder resin.

For the carrier, magnetic particles can be used. Examples of the magnetic particles include metal such as iron, ferrite and magnetite, and an alloy of these metal materials and metal such as aluminum or lead. Ferrite is preferable among these materials.

A resin-coated carrier formed by coating the magnetic particles with resin, or a resin-dispersed carrier formed by dispersing magnetic particles in resin may be used as the carrier. The type of resin coating the magnetic particles is not particularly limited. Examples of the resin include olefin-based resin, styrene-based resin, styrene acrylic resin, silicon-based resin, ester-based resin, and fluorine-containing polymer resin. The resin used in the resin-dispersed carrier is not particularly limited but includes, for example, styrene acrylic resin, polyester resin, fluorine resin and phenolic resin.

Though the volume average particle diameter of the carrier is not particularly limited, it is preferably between 30 μm and 50 μm inclusive in order to obtain a high-quality image. The resistivity of the carrier is preferably $10^8$ Ω·cm or more, and more preferably $10^{12}$ Ω·cm or more.

The resistivity of the carrier corresponds to a value obtained as follows. The carrier is placed in a container having a cross sectional area of 0.50 cm$^2$ and is tapped. Thereafter, a load of 1 kg/cm$^2$ is applied to the carrier in the container with a weight, and a voltage is applied thereto so as to generate an electric field of 1000 V/cm between the weight and a bottom electrode. The resistivity is obtained by reading the value of electric current generated here. If the resistivity of the carrier is low, a charge is injected into the carrier when the bias voltage is applied to the developer sleeve 17*y*, causing the carrier particles to be more easily deposited on the photoreceptor drum 11*y*. This also increases the possibility of a breakdown of the bias voltage.

The intensity of magnetization (maximum magnetization) of the carrier is preferably between 10 emu/g and 60 emu/g inclusive, more preferably between 15 emu/g and 40 emu/g inclusive. The intensity of the magnetization depends on the magnetic flux density of the developer sleeve 17*y*. Under a condition of general magnetic flux density of the developer sleeve 17*y*, however, a magnetic constraint force is not exerted when the intensity of the magnetization is less than 10 emu/g, possibly causing scattering of the carrier. Moreover, the intensity of the magnetization exceeding 60 emu/g makes it difficult to keep the carrier in non contact with the photoreceptor drum 11*y*, in a non-contact development in which bristles of the carrier are too high. In a contact development, on the other hand, a brush mark may easily appear on the toner image.

The carrier preferably has a sphere or flat shape. The mixture ratio of the toner to the carrier in the dual-component developers 16*y*, 16*m*, 16*c*, and 16*b* is not particularly limited but may appropriately be selected according to the type of the toner and the carrier.

In addition to the examples described above, various other modifications can be applied to the present invention. It should be understood that such modifications also fall within the scope of the present invention.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A fusing device for fixing an image to a sheet, comprising;

a fuser roller;

a tension roller arranged in parallel with the fuser roller;

an endless fuser belt stretched over the fuser roller and the tension roller;

a heater for heating the fuser belt; and a pressure roller pressed to the fuser roller through the fuser belt for conveying a sheet carrying an image formed with a developer while sandwiching the sheet between the pressure roller and the fuser belt, wherein the heater is arranged to be pressed to the fuser belt, and the tension roller has a thermal insulation member arranged at an outer circumference touching the fuser belt, wherein when the outer diameter of the tension roller is represented by "r" while the outer diameter of the fuser roller is represented by "R", "r " and "R" satisfy the relational expression indicated below:

$$r <= 2/3 * R.$$

2. The fusing device according to claim 1, wherein the heater is arranged inside an orbit around which the fuser belt revolves.

3. The fusing device according to claim 2, wherein the heater includes a heat generator and a heat transmission member having a surface touching the fuser belt forming an arc plane, for transmitting heat from the heat generator to the fuser belt.

4. An image forming apparatus, comprising:
a transfer portion for transferring an image formed with a developer to a sheet based on obtained image data; and
the fusing device according to claim 2, wherein
an image is formed by fixing an image with the fusing device.

5. The fusing device according to claim 3, wherein
a fluorine contained resin layer is formed on the surface of the heat transmission member.

6. An image forming apparatus, comprising:
a transfer portion for transferring an image formed with a developer to a sheet based on obtained image data; and
the fusing device according to claim 3, wherein
an image is formed by fixing an image with the fusing device.

7. An image forming apparatus, comprising:
a transfer portion for transferring an image formed with a developer to a sheet based on obtained image data; and
the fusing device according to claim 5, wherein
an image is formed by fixing an image with the fusing device.

8. The fusing device according to claim 1, wherein
the thermal insulation member arranged at the tension roller is formed with a porous material.

9. An image forming apparatus, comprising:
a transfer portion for transferring an image formed with a developer to a sheet based on obtained image data; and
the fusing device according to claim 8, wherein
an image is formed by fixing an image with the fusing device.

10. The fusing device according to claim 1, further comprising:
a detector for detecting a temperature of the fuser belt; and
a control portion for controlling power supplied to the heater such that the fuser belt has a set temperature based on a detection result obtained by the detector.

11. An image forming apparatus, comprising:
a transfer portion for transferring an image formed with a developer to a sheet based on obtained image data; and
the fusing device according to claim 10, wherein
an image is formed by fixing an image with the fusing device.

12. The fusing device according to claim 1, further comprising
a heater for heating the pressure roller.

13. An image forming apparatus, comprising
a transfer portion for transferring an image formed with a developer to a sheet based on obtained image data; and
the fusing device according to claim 12, wherein
an image is formed by fixing an image with fusing device.

14. The fusing device according to claim 1, further comprising
a heater for heating the fuser roller.

15. An image forming apparatus, comprising:
a transfer portion for transferring an image formed with a developer to a sheet based on obtained image data; and
the fusing device according to claim 14, wherein
an image is formed by fixing an image with the fusing device.

16. An image forming apparatus, comprising:
a transfer portion for transferring an image formed with a developer to a sheet based on obtained image data; and
the fusing device according to claim 1, wherein
an image is formed by fixing an image with the fusing device.

* * * * *